United States Patent [19]

Schneider

[11] 4,083,064

[45] Apr. 11, 1978

[54] INFANT THERMAL SHIELD

[76] Inventor: Keith M. Schneider, 195 Wildwood Rd., Great Neck, N.Y. 11024

[21] Appl. No.: 563,222

[22] Filed: Mar. 28, 1975

[51] Int. Cl.[2] ..... A41D 3/00

[52] U.S. Cl. ..... 2/69.5

[58] Field of Search ..... 2/69.5, 69, 2, DIG. 7, 2/83; 5/343

[56] References Cited

U.S. PATENT DOCUMENTS

| | | | |
|---|---|---|---|
| 2,469,700 | 5/1949 | Petrucelli | 2/69.5 |
| 2,675,552 | 4/1954 | Jackson | 2/69.5 |
| 2,931,043 | 4/1960 | Achner | 2/69.5 |
| 3,304,556 | 2/1967 | Meyers et al. | 2/69.5 |
| 3,636,566 | 1/1972 | Sutherland | 2/69.5 |
| 3,739,399 | 6/1973 | Sheahon | 2/69.5 |

FOREIGN PATENT DOCUMENTS

| | | | |
|---|---|---|---|
| 1,263,071 | 2/1972 | United Kingdom | 2/69.5 |

*Primary Examiner*—H. Hampton Hunter
*Attorney, Agent, or Firm*—Peter L. Berger

[57] ABSTRACT

An infant thermal shield is formed of a bag of a plastic such as polyethylene which is a material of solid monolithic non-cellular cross-section which is adapted for permitting the audio detection therethrough of body functions. The bag is provided with a hoodless neck opening and is furthermore provided with a longitudinal opening of continuous linear form located frontally or laterally with respect to the bag. The bag is furthermore provided with a bottom opening which can be selectively sealed or held in gathered relationship in order to permit the ingress and egress of connections to medical apparatus. A closing arrangement is provided which is preferably formed of strips of pressure responsive material. The material from which the bag is fabricated is adapted for being held in skin tight relationship over limited portions of the infant so as to permit the effective use of the head of a stethoscope or the cuff of a blood pressure measuring apparatus. The bag is moreover provided with at least one and sometimes two arms into which the arms of the infant can be extended.

19 Claims, 4 Drawing Figures

INFANT THERMAL SHIELD

FIELD OF INVENTION

This invention relates to infant thermal shields and, more particularly, to thermal shields especially suitable for use in delivery rooms for the protection of new born infants and for use in operating rooms as well as for transportation of infants within and outside of hospitals.

BACKGROUND

As has been discussed in available literature, modern delivery rooms are designed for the gowned physician and are not generally thermally suitable for naked newly born infants. The normal healthy neonate can be wrapped in blankets and transferred to a nursery and if this is done efficiently and within a relatively short period following delivery, the infant is probably not harmed by the delivery room environment. Exposure to cold surroundings, however, will adversely affect the newly born infant and heat loss is preferably to be avoided.

Environmental cold stress in newly born infants results in an increase of oxygen consumption, metabolic acidosis, depression of arterial oxygen tension and production of a hyperthyroid state. A thermal environment that induces a minimal rate of oxygen consumption is preferred. This implies a normal and unchanging body temperature.

A wrap particularly adapted to keep a new born baby warm until his thermal regulatory mechanism gains stability has been disclosed in U.S. Pat. No. 3,739,399, which issued to J. Sheahon on June 9, 1973. The wrap disclosed in this patent comprises a specially shaped and cut sheet of flexible plastic material which is nonabsorbent, transparent, thermally insulating and suffocation proof. It is constructed with a series of flaps on each side of a sheet which flaps fold over the front of the baby as he lies supine on the central area thereof. Opposing flaps are offset and overlap so that air gaps are allegedly not created by slits in the sheet that form the flaps on each side. Air pockets are employed for insulating the sheet and a hood is provided for the head.

This construction had not been found particularly effective nor has it found wide usage. Moreover, while the air pockets employed in the material used for this construction aid in achieving a neutral thermal environment in as effective a manner as is possible, the material interferes with the handling and medical supervision of the newly born infant and with various other procedures and operations which must be effected relative thereto.

Another type of construction is a swaddler disclosed in U.S. Pat. No. 3,636,566 which issued to J. Sutherland on Jan. 5, 1972. This swaddler is formed of a cellular laminate of transparent plastic sheet material which is folded upon itself to form a bag. The material has an integral extension projecting from the opening of the bag which is adapted for being wrapped about the head of the baby lying within the bag to form a hood for the same.

The provision of this hood is found to interfere with the neutral thermal environment which is desired while at the same time, the use of the cellular laminate interferes with the medical supervision of the bodily functions of the newly born infant. Furthermore, the arrangement provided in this patent does not conveniently permit such operations as drawing blood from the baby's limbs in facile manner or the introduction and use of supervisory and regulatory medical apparatus such as may be employed in connection with monitoring rectal temperature and observing heart functions and blood pressure.

Another transparent baby bag is disclosed by Nicholas Besch et al in Vol. 284, No. 3 of THE NEW ENGLAND JOURNAL OF MEDICINE. The transparent baby bag disclosed in this publication is subject to the various disadvantages noted above and, particularly, is characterized by the utilization of a plastic material provided with air pockets sealed between two layers of polyethylene coated with polyvinylidene which is normally used as a cushioning in commercial packaging. This material also interferes with the supervision of bodily functions as discussed hereinabove.

I am aware of no other forms of infant shields which protect against heat loss but I am aware of U.S. Pat. No. 3,034,134 which discloses an adjustable blanket bunting or swathing which offers protection against the elements. This patent does not relate to protection for newly born infants and, consequently, is not believed pertinent to the subject matter of the instant invention. Additionally, I am aware of U.S. Pat. No. 2,657,387 which discloses improvements in infants' garments and refers particularly to an over-garment which entirely encloses an infant for protection from rain and dampness. This patent likewise does not relate to newly born infants nor the problems discussed hereinabove and consequently is also not believed pertinent to the present invention.

Furthermore, U.S. Pat. No. 2,675,552 which issued to L. Jackson on Apr. 20, 1954 relates to a baby bunting and, more particularly, to a waterproof bunting designed to protect a baby and its clothes from rain and snow rather than to provide warmth. By its very definition, this patented invention does not apply to the subject matter disclosed herein. Similarly, U.S. Pat. No. 2,931,043 relates to a salving bag which is to be used for wrapping up injured persons while they are being transported to a station whereat they may receive medical treatment. While this patent discloses a lightweight bag, it does not provide a bag which has the various advantages to be discussed hereinafter.

Furthermore noted, preparatory to a filing of the present application were U.S. Pat. Nos. 2,121,788; 3,750,202; 3,738,902; and 3,798,676. None of these patents have been found to relate to the structure of the instant invention nor the advantages achieved thereby.

SUMMARY OF INVENTION

It is an object of the invention to provide an improved infant thermal shield, especially suitable for maintaining thermal stability and a neutral thermal environment in delivery rooms and operating rooms as well as inside and outside of hospitals and the like with respect to newly born infants.

It is another object of the invention to provide an adequate infant covering for use in areas where exogenous sources of heat are unavailable or inadequate.

It is a further object of the invention to provide improvements in infant thermal shields relative to those types of devices providing for the use of double-layer air pocket plastic materials which are cumbersome and which interfere with the observation and monitoring of bodily functions.

It is another object of the invention to provide an improved thermal shield which is readily stored and applied and which permits covered infants to be easily handled and observed.

Yet another object of the invention is to provide for an improved thermal shield which enables breath and heart sounds to be clearly observed audibly by the use of stethoscope or the like directly through the material constituting the thermal shield and which also permits the measurement of blood pressure through such material.

Still another object of the invention is to provide an improved shield of a design adapted to permit a close fit as well as sealing and re-sealing after the insertion of catheters and the administration of medication and the like.

Advantageously, the construction of the invention provides a thermal effectiveness which has been tested in delivery rooms with mean ambient temperatures of 68° Farenheit. All of the advantages discussed hereinabove were readily attained by the use of the structures of the invention as set forth more fully hereinafter.

To achieve the above objects and advantages of the invention, there is provided an infant thermal shield comprising a bag of a material of solid monolithic noncellular cross-section which is adapted for permitting the audio detection therethrough of body functions, said bag being provided in robe-like form for draping the infant, and means for sealing the bag closed, said material being adapted for being held in skin tight relationship over limited portions of the infant, at least corresponding to the area of the head of a stethoscope or the like.

The structure of the invention advantageously includes one or two permanently sealed arms which are adapted for being cut open for permitting the insertion of catheters and the like. Advantageously, the bag of the invention is provided with a neck opening constituting one extremity of the bag, the bag being hoodless and the neck opening being round and collarless.

The bag of the invention is preferably provided with a single continuous longitudinal opening of linear form which is either frontally located or laterally located. When the opening is frontally located, the bag will generally be provided with two arms extending laterally of the bag and inclined downwardly relative to the same. If the bag is provided with a laterally located longitudinal opening, the bag normally will be provided with a single arm into which one arm of the infant may be inserted for purposes of the supervision of blood pressure and the insertion of catheters and the like. The other arm may be left inside or outside the unit by having an appropriate gap in the lateral opening without substantially sacrificing heat protection.

The bag is furthermore preferably provided with a bottom opening which may be closed by a pressure sensitive adhesive material or which may be provided with a rubber band or twistable wire or the like such that the bottom portion of the bag may be held in gathered relationship which is substantially closed but which permits the ingress and egress of connections to supervise relevant medical apparatus.

The bag may preferably be formed of two flat portions in face to face relationship, these portions being peripherably sealed together subject to the limitations mentioned hereinabove.

The material of the invention is preferably polyethylene which is, in turn, about 0.003 inches thick which may vary within a range of, for example, 0.001–0.010 inches.

The material of the invention is preferably fireproof and of physical characteristic such that it is nonabsorbent, transparent, thermally insulating and suffocation-proof.

The above and other objects and features of the invention will be found in the following detailed description as illustrated in the accompanying drawing.

DETAILED DESCRIPTION

According to the invention, there is provided an infant thermal shield comprising a bag of a material of solid monolithic noncellular cross-section which is adapted for permitting the audio detection therethrough of body functions. This bag is provided in robe-like form adapted to drape an infant and is moreover provided with arrangements for being sealed closed so that the infant is retained therein in such a manner as to assure a neutral thermal environment. The material of the invention may be regarded as being such that it permits limited portions of the same to be held in skin tight relationship against the infant over areas corresponding at least to the area of the head of a stethoscope and to, for example, the cuff of a blood pressure monitoring apparatus (e.g., about ½ to 4 or 5 square inches).

The material employed in accordance with the invention to permit the above result is preferably polyethylene having a thickness of 0.001–0.010 inches and within this range a thickness of 0.003 inches has been found particularly suitable for constituting a material which not absorbent but is transparent, fireproof, thermally insulating and suffocation proof. Polyethylene in this thickness range is visually non-distortive. Preferably, both surfaces thereof are smooth. Material of the above size is too thick to mold to an infant's face and this is proof against suffocation.

Not only does the material of the invention afford the above-noted characteristics but moreover it is far less bulky than those employed in thermal shields heretofore conceived and, therefore, provides a great facility with respect to storage and sterilization. Moreover, the specified material in the dimensions indicated surprisingly affords the proper degree of thermal shielding while avoiding overheating in connection with features to be mentioned hereinbelow.

Figure 1:
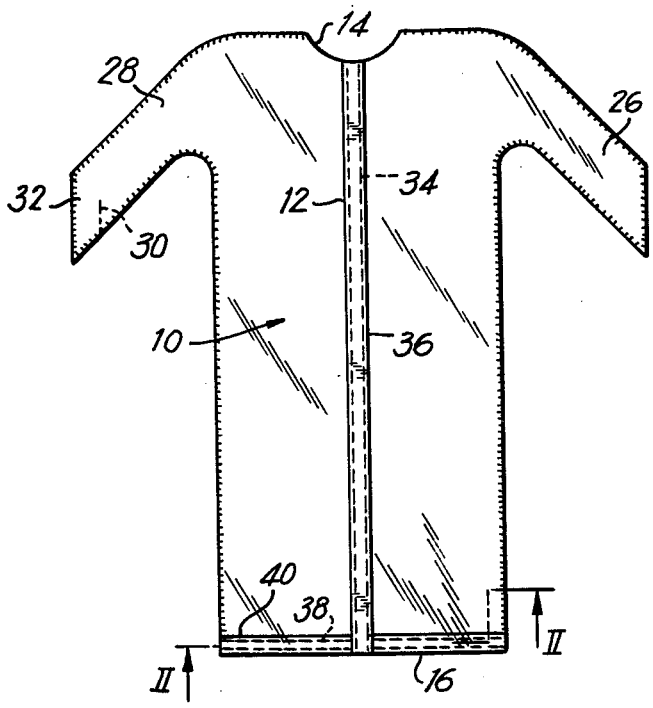
FIG. 1, is a front plan view of a thermal shield provided in accordance with one embodiment of the invention.
Figure 2:
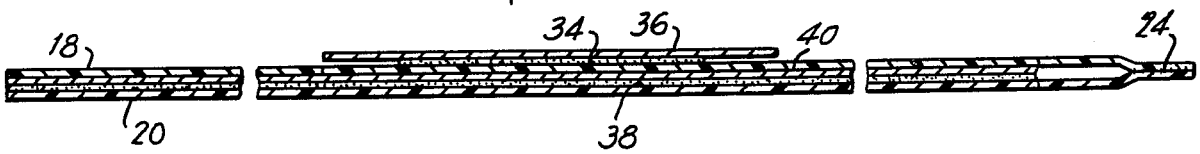
FIG. 2 is a cross-sectional view, on enlarged scale, partially broken away and taken along line II—II in FIG. 1.

FIGS. 1 and 2 illustrate one embodiment of the invention and depict a bag 10 having a longitudinal opening 12 which is a single continuous linear opening extending from the neck 14 to the bottom edge 16. The bag is formed of two flat sections 18 and 20 generally arranged in face-to-face relationship and preferably sealed together such as indicated at 24.

In the particular embodiment illustrated in FIGS. 1 and 2, two arm portions 26 and 28 are provided. These arm portions extend laterally outwards and are inclined downwardly relative to the main body of the bag 10. The arms 26 and 28 are permanently sealed but being of the material indicated above permit a slitting such as indicated at 30 to afford access to the arm of the infant located within the bag. This permits folding back the cuff portion 32 for the insertion of a catheter or the like whereafter the cuff portion 32 may be rearranged around the opening in the related arm to close the same completely.

The frontal opening 12 mentioned hereinabove is closed after the draping of the infant by means of a strip of pressure responsive adhesive indicated at 34 and covered until use by a strip of waxed paper or the like indicated at 36. Removal of the strip of waxed paper 36 exposes the pressure responsive adhesive whereby one edge of the frontal opening 12 may be overlapped and connected to the other edge and whereby various sizes of infants may be readily accommodated by overlapping the edges of the opening 12 to the degree necessitated by the size of the infant.

The bottom edge is similarly sealed by the use of a strip of pressure responsive adhesive indicated at 38 and covered by a strip of protective material indicated at 40. Removal of the protective material 40 exposes the pressure responsive adhesive material 38 which can be folded up upon the main body of the bag to the extent desired to close off the bottom portion of the bag. Strips 38 and 34 are cooperatively arranged in inverted T relationship.

While a pressure responsive material has been indicated hereinabove, other material and arrangements are also possible within the scope of the invention as will be explained more fully below and inclusive, for example, of the use of Velcro, snaps, medically acceptable adhesives and the like.

A feature of the invention consists of the neck opening 14. It will be noted that this neck opening is round and collarless and that the neck opening 14 constitutes one extremity of the bag, the bag being of a hoodless design. Whereas it was previously believed that a hood was essential for affording a thermally desirable environment, we have found that a hood is not necessary and is indeed, undesirable. The head of a newly born infant, it is true, is percentagewise large compared, for example, to the percentage in an adult. Nevertheless, in an infant, the head constitutes only about 15% of the heat losing surface of the body of the infant. The heat shield of the invention is thus intended to protect about 85% of the heat radiating surface of the new born infant. As a consequence, we use the head to radiate a relatively small degree of heat to prevent overheating. We, therefore, achieve a thermally neutral environment partly by the omission of the use of the hood. Other features of the invention directed supplementally to this desirable result include, without limitation, the particular type of material which is employed. At the same time, with the material we employ we are able to avoid completely any possibility of suffocating the infant. It should be noted that the material of the invention lying within the scope indicated hereinabove thus operates in conjunction with a lack of a hood or the like to provide the thermally neutral environment and also that these features cooperate to prevent infant suffocation.

Additionally, the use of the specified material permits the infant to be easily handled. More particularly, solid monolithic noncellular characteristic of the material permits this material, in effect, to form an additional skin which has inherently a coefficient of friction and a conformity to the body which permits the infant to be handled without any loss of facility.

In addition, the material of the invention is particularly suitable for being held in skin tight relationship over the limited portions of the infant's body. These portions may have an area of about ½ to 4 or 5 square inches and correspond in size to the area of the head of a stethoscope or to the cuff of a blood pressure monitoring device such as the Doppler devices currently in use.

Thermal shields of the invention have been tested in delivery rooms with mean ambient temperatures of 68° Farenheit. Thirty fulltime healthy new born babies were randomly assigned to three groups. One group was placed under radiant heaters, severally controlled at a skin temperature at 99° Farenheit to achieve a core temperature of 98.6° Farenheit. Group 2 was dressed in the polyethylene gowns of the invention while Group 3 was gowned and placed under the aforenoted heaters. Rectal and abdominal skin temperatures were recorded at 5 minute intervals. Mean rectal temperatures over a 30 minute period ranged as indicated in the following table:

TABLE

| | n | 5' | 10' | 15' | 25' | 30' | | Skin Temps. |
|---|---|---|---|---|---|---|---|---|
| Group I | 10 | 98.6 | 98.5 | 98.4 | 98.5 | 98.4 | 98.3 | 96.0–100.0 |
| Group 2 | 10 | 97.8 | 97.6 | 97.8 | 97.7 | 97.8 | 97.9 | 95.4– 95.7 |
| Group 3 | 10 | 98.4 | 98.3 | 98.6 | 98.5 | 98.4 | 98.7 | 96.0–100.0 |

Although the core temperatures in Group 2 were significantly lower than in Groups 1 or 3 ($P<0.01$), gowned babies were maintained consistently within the range of thermal neutrality. Several controlled heating of infants and gowns did not result in hyoerthermia.

Figure 3:
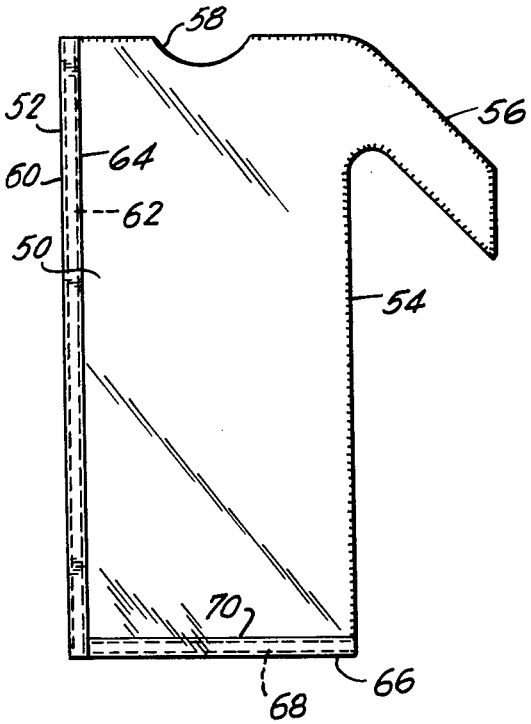
FIG. 3 is a front plan view of a second embodiment of the invention.

FIG. 3 illustrates a further embodiment of the invention in accordance with which a bag 50 of the material indicated above has an open lateral edge indicated at 52 and a completely sealed lateral edge 54 arranged opposite to edge 52 and provided with a laterally extending arm 56 permanently sealed in known manner.

The bag 50 illustrated in FIG. 3 is provided with a round open collarless and hoodless neck such as indicated at 58 for the reasons discussed hereinabove relative to the previously described embodiment.

In the embodiment of the invention illustrated in FIG. 3, there is provided the pressure responsive adhesive for closing the continuous, laterally disposed longitudinal opening 60, the pressure responsive material indicated at 62 being provided with a removable covering indicated at 64. The open bottom 66 of the bag 50 is likewise provided with a pressure responsive adhesive strip 68 provided with a removable cover 70.

Figure 4:
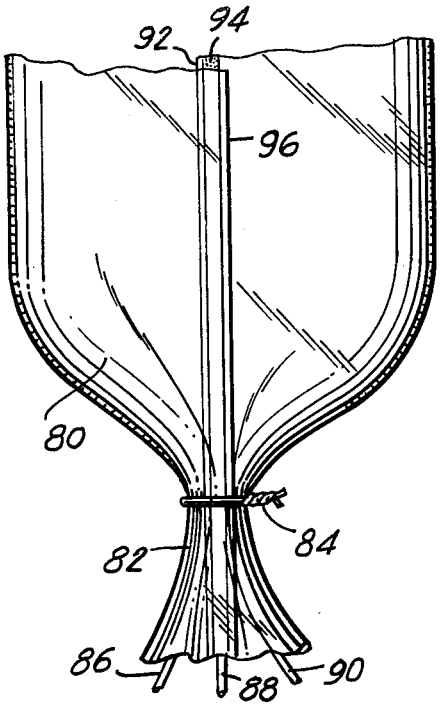
FIG. 4 is a fragmentary view of the bottom section of a thermally effective infant shield provided in accordance with another embodiment of the invention.

A further embodiment of the invention is illustrated in FIG. 4 which depicts an arrangement in which a bottom sealing strip is not employed. Instead, the bottom of the bag 80 illustrated in FIG. 4 is held in gathered relationship such as indicated at 82 by means of a fastening device 84 which may be constituted, for example, of a rubber band or of a piece of twistable wire covered by a suitable protective material such as paper or cloth. By these means, the gathered arrangement 82 substantially closes the bottom of the bag 80 while permitting nevertheless an opening for the ingress and egress of connections such as indicated at 86, 88 and 90 which lead to and from supervisory or regulatory medical apparatus or the like.

In the embodiment of the invention illustrated in FIG. 4, there is, as noted above with respect to one of the prior embodiments, a frontal opening 92 which is closeable by means of a strip of pressure responsive adhesive such as indicated at 94. The overlapping edge is seen at 96.

The constructions of the invention provide superior infant coverings for use in areas where exogenous sources of heat are unavailable or inadequate. The provisions of the invention avoid the use of cumbersome materials such as those provided with air pockets and the like which interfere with visual observations and monitoring. The single-layer monolithic solid transparent gown of the invention provides in conjunction with the hoodless construction a thermally neutral environment for new born infants and permits gowned infants to be easily handled and observed and furthermore enables breath and heart sounds and the like to be audibly monitored by stethoscopes and like medical apparatus. The adhesive strips of the invention permit a close fit and reseal after the insertion of catheters or the administration of medication and the like. Moreover, the various advantages discussed hereinabove are readily achieved.

The invention provides for the facile use of rectal thermocouple probes and the like equipment and facilitates the use of the cautery for hemostasis or the control of breathing. The construction of the invention provides for less bulk and thereby facilitates storage and sterilization.

The invention avoids overheating of the shielded and gowned infant and provides a very effectively controlled thermally neutral environment. The invention makes especially convenient provisions for the introduction of intervenous lines and connections to regulatory and supervisory medical apparatus.

The lesser bulk of the material of the invention facilitates handling of the new born infants and the shield of the invention have been well responded to by assisting medical personnel.

There will now be obvious to those skilled in the art many modifications and variations of the structures set forth above. These modifications and variations will not depart from the scope of the invention if defined by the following claims.

What is claimed is:

1. A thermal shield for a neonate whose thermal regulatory mechanism has not yet gained stability, comprising a garment in robe-like form of transparent material of solid monolithic non-cellular cross-section, the garment being of a size generally corresponding to the size of neonates whose thermal regulatory mechanism has not yet gained stability, but permitting the insertion of implements between the material and the neonate's body, the material being sufficiently pliable so as to conform generally to the neonate's body when draped over the neonate's body and so as to be capable of being manually held in skin tight contact with portions of the neonate corresponding to at least the area of the head of a stethoscope but not so pliable as to be capable of molding to the configuration of the neonate's face and thereby suffocating the neonate, the garment having a sealable vertical open edge for facilitating placing the garment on the neonate, means for sealing the vertical open edge and a neck opening constituting one extremity of the garment whereby the garment is hoodless.

2. A thermal shield as claimed in claim 1 wherein the material is a plastic which is polyethylene having a thickness of 0.001–0.010 inches.

3. A thermal shield as claimed in claim 1 wherein the garment includes arms.

4. A thermal shield as claimed in claim 1 wherein the vertical open edge is frontally centrally located.

5. A thermal shield as claimed in claim 1 wherein the vertical open edge is laterally located along one side of the garment.

6. A thermal shield as claimed in claim 1 wherein the garment is provided with a sealable bottom open edge.

7. A thermal shield as claimed in claim 1 wherein said sealing means is a pressure sensitive adhesive material including a removable protective covering.

8. A thermal shield as claimed in claim 1 wherein the garment includes two flat portions in face-to-face relation and perhipherally sealed together.

9. A thermal shield as claimed in claim 6 wherein the garment includes two flat portions in face-to-face relation perhipherally sealed together.

10. A thermal shield as claimed in claim 3 wherein the material is about 0.003 inches thick.

11. A thermal shield as claimed in claim 9 wherein the material is about 0.003 inches thick.

12. A thermal shield as claimed in claim 9 wherein the garment includes arms extruding laterally thereof and at a downward inclination.

13. A neonate thermal shield as claimed in claim 9 wherein said pressure sensitive adhesive includes strips arranged in a T-relationship, the garment is provided with a sealable bottom open edge and said strips function as means for sealing both sealable open edges.

14. A thermal shield as claimed in claim 1 wherein said material is transparent and visually non-distortive.

15. A thermal shield as claimed in claim 1 wherein said material has smooth surfaces.

16. A thermal shield as claimed in claim 14 wherein said garment has lateral edges and includes a single arm extending laterally from only one said edge and is provided with a continuous longitudinal linear opening extending along the opposite lateral edge and with a bottom opening, said means including a fastener extending along said opposite edge.

17. A thermal shield as claimed in claim 6 wherein said garment has lateral edges and includes a single arm extending laterally from only one said edge and is provided with a continuous longitudinal linear opening extending along the opposite lateral edge and with a bottom opening, said means including a fastener extending along said opposite edge.

18. A thermal shield as claimed in claim 1 wherein said garment has an open bottom edge and the shield includes a fastener for holding the bottom in gathered substantially closed condition permitting the extension therethrough of connections to medical apparatus within the bag.

19. A thermal shield as claimed in claim 6 wherein the neck opening is round and collarless.

* * * * *